US006238498B1

(12) United States Patent
Ohriner et al.

(10) Patent No.: US 6,238,498 B1
(45) Date of Patent: May 29, 2001

(54) METHOD OF FABRICATING A HOMOGENEOUS WIRE OF INTER-METALLIC ALLOY

(75) Inventors: Evan Keith Ohriner; Craig Alan Blue, both of Knoxville, TN (US)

(73) Assignee: U T Battelle, Oak Ridge, TN (US)

( * ) Notice: Subject to any disclaimer, the term of this patent is extended or adjusted under 35 U.S.C. 154(b) by 0 days.

(21) Appl. No.: 09/268,461

(22) Filed: Mar. 16, 1999

(51) Int. Cl.[7] ..... C21D 8/00; C21D 9/52

(52) U.S. Cl. ..... 148/648; 148/595; 148/598; 148/654

(58) Field of Search ..... 148/512, 648, 148/242; 427/329, 383.7

(56) References Cited

U.S. PATENT DOCUMENTS 5,447,754 * 9/1995 Jasper ..... 427/320
5,525,779 * 6/1996 Santella et al. ..... 219/137
5,824,166 * 10/1998 McDonald ..... 148/428
5,846,351 * 12/1998 Masahashi et al. ..... 148/671
5,980,659 * 11/1999 Kawaura et al. ..... 148/535
6,010,580 * 1/2000 Dandliker et al. ..... 148/403
6,019,736 * 2/2000 Avellanet et al. ..... 600/585

* cited by examiner

*Primary Examiner*—Roy King
*Assistant Examiner*—Harry D. Wilkins, III
(74) *Attorney, Agent, or Firm*—J. Herbert O'Toole; Hardaway/Mann IP Group Nexsen Pruet Jacobs & Pollard, LLC

(57) ABSTRACT

A method for fabricating a homogeneous wire of inter-metallic alloy comprising the steps of providing a base-metal wire bundle comprising a metal, an alloy or a combination thereof; working the wire bundle through at least one die to obtain a desired dimension and to form a precursor wire; and, controllably heating the precursor wire such that a portion of the wire will become liquid while simultaneously maintaining its desired shape, whereby substantial homogenization of the wire occurs in the liquid state and additional homogenization occurs in the solid state resulting in a homogenous alloy product.

6 Claims, 1 Drawing Sheet

METHOD OF FABRICATING A HOMOGENEOUS WIRE OF INTER-METALLIC ALLOY

STATEMENT AS TO RIGHTS TO INVENTIONS MADE UNDER FEDERALLY SPONSORED RESEARCH AND DEVELOPMENT

The U.S. Government has rights in this invention pursuant to contract number DE-AC05-96OR22464 between Lockheed Martin Energy Research Corporation and the Department of Energy.

FIELD OF THE INVENTION

The present invention relates generally to intermetallic alloy wire, and more particularly to the fabrication of a homogeneous intermetallic alloy wire which can be produced in a much larger range of wire diameters with better handling and feeding characteristics.

BACKGROUND OF THE INVENTION

Intermetallic alloys such as provided by nickel aluminides, iron aluminides and titanium aluminides are increasingly utilized in engineering structures in place of other metals, such as stainless steel. Intermetallic alloys have been found to be less expensive and to possess highly desirable mechanical properties at elevated temperatures. Developments in these intermetallic alloys have resulted in significant improvements in their mechanical properties so as to even further increase their suitability for use in engineering structures.

U.S. Pat. No. 5,525,779 to Santella et al, which is commonly assigned herewith and incorporated herein by reference, points out several developments in the art of intermetallic alloys. Santella et al specifically addresses a problem in the art associated with the welding of intermetallic alloys due to difficulties encountered in processing the alloys into consumable welding rods or wires by employing known metal working techniques. However, Santella et al describes an inhomogeneous wire which is most useful as welding wire.

SUMMARY OF THE INVENTION

It is an object of this invention to produce a homogeneous wire of intermetallic alloy with useful properties which can be used for a wide range of applications This and other objects of the invention are achieved by a method for fabricating a homogeneous wire of inter-metallic alloy comprising the steps of providing a base-metal wire bundle comprising a metal, an alloy or a combination thereof; working the wire bundle through at least one die to obtain a desired dimension and to form a precursor wire; and, controllably heating the precursor wire such that a portion of the wire will become liquid while simultaneously maintaining its desired shape, whereby substantial homogenization of the wire occurs in the liquid state and additional homogenization occurs at an elevated temperature below the melting point resulting in a homogenous alloy product.

DETAILED DESCRIPTION OF THE INVENTION

The present invention introduces a direct fabrication method for nickel aluminide, iron aluminide or titanium aluminide intermetallic alloy wire. Intermetallic alloys have been shown to have good strength and oxidation resistance at elevated temperatures. In particular, nickel aluminides, iron aluminides and titanium aluminides show excellent properties at elevated temperatures. In many instances, the application of these materials is limited by the difficulty and cost of fabricating these alloys into a desired shape. This is particularly true for wire products and foils. Intermetallics, in the past, have not been economically fabricated into wire because the materials could not be cold worked readily due to a very high rate of work hardening, which then requires frequent annealing of the material. In other cases, the material could not be hot worked due to oxygen-induced cracking during the deformation process.

Commercial interest in intermetallic alloys is substantial because the raw materials costs are substantially less than for many materials used in high temperature applications, particularly in the case of iron aluminide. The fabrication process of the present invention reduces processing costs dramatically and allows the production of wire, fibers, foils, wool, and other shapes with the desired high temperature properties useful for a wide range of applications. Thus, there remains room for improvement in the art.

Figure 1:
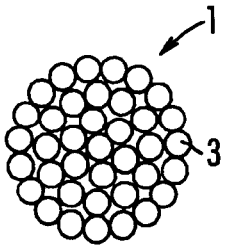
FIG. 1 is a cross section of a precursor wire bundle of the present invention.

FIG. 1 of the drawings illustrates a precursor wire bundle 1 in cross section which is not homogeneous but has the overall desired composition of the finished wire. The precursor wire bundle 1 may be fabricated by the mechanical assembly of a composite of individual rods and/or wires 3. Alternatively, precursor wire bundle 1 may be made by passing a composite of individual rods 3 through a bath of molten aluminum or aluminum alloy. In either instance, an individual rod 3 in the assembly may comprise a core of one metal or alloy and an outer region of another metal or alloy; or the rod may comprise a single metal or alloy. A plurality of individual rods or wire 3 are brought to a high density and to the desired diameter by conventional means.

In a preferred embodiment of the present invention, the precursor wire bundle 1 of rods 3 are brought to the desired density and diameter by drawing and/or extrusion operations. Wire bundle 1 with a proper or desired average composition, may be pulled through a die or dies to obtain the desired dimensions and then processed into mesh, gauze, foil or another shape. The process of assembling and shaping the wire bundle 1 is simplified due to the inhomogeneous composition of the wire bundle 1 which provides for high ductility. Additionally, the process is simplified due to the easy processing of the constituent metals or alloys which make up the precursor wire bundle 1.

Figure 2:
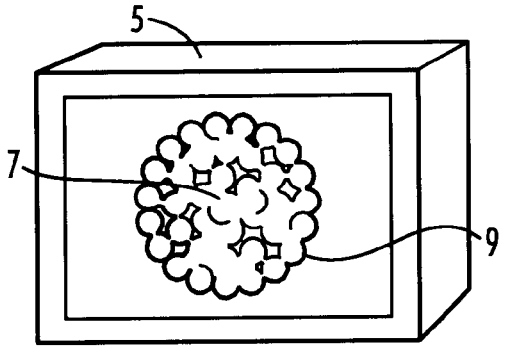
FIG. 2 is a schematic representation of the heating process of the precursor wire during which alloying and homogenization occur.

With reference to FIG. 2, the precursor wire bundle 1, which has been treated as described above, hereinafter referred to a precursor 1, is heated by conventional means such as by resistive, inductive, or conductive heating in an oven, or by radiative heating in an infrared oven, such as oven 5. The heating environment of oven 5 is preferably a protective environment comprising a gas, such as argon or nitrogen to prevent oxidation. Care is taken during heating to avoid maintaining the precursor 1 at a temperature where substantial diffusion occurs between the components which make up the wire. If reaction or diffusion occurs, embrittlement or rapid work hardening of the precursor 1 material may occur. Therefore, the precursor wire 1 is heated under controlled conditions of rate, hold temperature, and time to quickly form a liquid phase and obtain a homogeneous alloy product.

Heating is controlled so that some of the wire will become liquid for a short time, as seen at 7, while maintaining the general shape of the wire 1 by the presence of some solid regions, as seen at 9. The solid regions 9 also provide for mechanical strength so that the wire can be handled during processing. The great advantage of this process is that much of the alloying and homogenization occur rapidly in the liquid state, as seen at 7.

Figure 3:
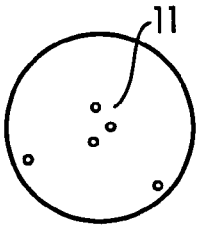
FIG. 3 is a cross section of the product of the present invention illustrating some internal porosity.

Once the liquid state alloying and homogenization have occurred, the precursor wire 1 is allowed to become solid at a solidification temperature. After solidification, the wire 1 is held at a temperature below its melting point and final homogenization occurs by solid state diffusion. The reaction to form the homogeneous wire can occur with rapid heating to and cooling from an elevated temperature. Typically the heating and homogenization process results in some internal porosity, as illustrated in FIG. 3 at 11. The homogenized wire 1, may be brought to full density by conventional means of thermo-mechanical processing, such as by drawing, rolling, annealing, hot pressing, hot isostatic pressing or other means.

EXAMPLE 1

Figure 4:
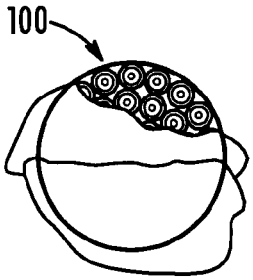
FIG. 4 is another cross section of a homogeneous intermetallic alloy wire produced in accordance with the present invention.

As an example, a precursor wire 100, FIG. 4, is fabricated consisting of nickel and aluminum with an overall average composition of nickel with a 20 atomic percent aluminum and an overall diameter of 0.75 mm. The precursor wire comprises sixty-two fibers with a nickel core, an aluminum intermediate layer, and an outer covering of nickel. The precursor wire 100 constituted a fully dense wire.

The precursor wire 100 was heated to a temperature of 1300° C. in an argon atmosphere for sixteen minutes. The resulting homogeneous wire 100 produced upon heating was ductile and could be readily bent. The microstructure of the wire was single phase. Microchemical analysis performed on the mounted and polished cross section of the wire showed the material to be completely homogeneous.

The direct fabrication process for intermetallic alloy wire has tremendous economic potential. There are numerous industrial processes which are limited in temperature capability and efficiency due to the lack of suitable economical heating elements. The ability to increase processing temperatures through the use of intermetallic alloy wire will, in many cases, result in reduced energy usage. There are also large consumer applications for heating elements. In those cases where radiant heating is the primary function of the heating element, any increase in operating temperature will produce substantial increase in the efficiency of the system. Examples include radiant space heaters and electrical toasters. Industrial applications include baskets used in the heat treating and processing industries, as well as the meshes and gauze of intermetallic alloys for filters used in industrial heating applications.

The invention may be extended to other intermetallic systems in addition to aluminides. For example, a wire with a concentration gradient, including a cored wire with a high conductivity interior and a high-strength oxidation-resistant coating may be produced. The invention may also be extended to dispersion strengthened intermetallic alloy wires in which the dispersant is added directly as an oxide or other compound produced by reaction with oxygen or another gas. The precursor wire, when reacted to produce the intermetallic alloy, will typically have a controlled amount of porosity within the wire which is continuous along the length of the wire, and which aides in reaction to form the dispersant material.

It is thus seen that a novel method of fabricating intermetallic wire has been described. It will, therefore, be readily understood by those persons skilled in the art that the present invention is susceptible of broad utility and application. Many embodiments and adaptations of the present invention other than those described, as well as many variations, modifications and equivalent arrangements will be apparent from or reasonably suggested by the present invention and foregoing description thereof, without departing from the substance or scope of the present invention as defined by the following appended claims.

We claim:

1. A method for fabricating a homogeneous wire of inter-metallic alloy comprising the steps of:

providing a base-metal wire bundle comprising a metal, an alloy or a combination thereof;

working said wire bundle through at least one die to obtain a desired shape and dimension and to form a precursor wire; and, controllably heating said precursor wire such that a portion of said wire becomes liquid while simultaneously maintaining said desired shape;

whereby substantial homogenization of said wire occurs in the liquid state and additional homogenization then occurs in the solid state resulting in a homogenous alloy product.

2. The method for fabricating according to claim 1, wherein said bundle is formed by assembling a plurality of individual wires or rods.

3. The method of fabricating according to claim 2, wherein said step of assembling comprises the step of passing said individual wires or rods through a molten bath comprising aluminum or aluminum alloy.

4. The method of fabricating according to claim 1, further comprising the step of thermo-mechanically processing said homogenous alloy product, whereby said alloy product is densified.

5. A method for fabricating a homogeneous wire of inter-metallic alloy comprising the steps of:

providing a plurality of base-metal wires formed from a material selected from the group consisting of nickel, nickel alloys, iron, iron alloys, titanium, or titanium alloys and of aluminum or aluminum alloys;

forming a wire bundle from said plurality of base-metal wires;

moving said wire bundle through at least one die to obtain a desired dimension, thus forming a precursor wire; and, controllably heating said precursor wire such that a portion of said wire becomes liquid for a period of time while simultaneously maintaining its shape;

whereby substantial homogenization of said wire occurs in the liquid state and additional homogenization then occurs in the solid state resulting in a homogenous alloy product.

6. A method for fabricating a homogeneous wire of inter-metallic alloy comprising the steps of:

providing a plurality of base-metal wire or rods formed from a material selected from the group consisting of nickel, nickel alloys, iron, iron alloys, titanium, or titanium alloys and of aluminum or aluminum alloys, and mixtures thereof;

forming a wire bundle from said individual wires or rods;

moving said wire bundle through at least one die to obtain a desired dimension and to form a precursor wire;

controllably heating said precursor wire such that a portion of said precursor wire becomes liquid for a period of time, whereby substantial homogenization occurs in the liquid state;

holding said precursor wire at a temperature below a melting point, whereby additional homogenization occurs and an intermetallic alloy wire is formed; and, thermo-mechanically treating said intermetallic alloy wire to densify said homogeneous intermetallic alloy wire.

* * * * *